United States Patent [19]

McFarlane

[11] 3,993,350

[45] Nov. 23, 1976

[54] SEAT ARM ADJUSTMENT MECHANISMS

[75] Inventor: Arthur Herbert McFarlane, Basildon, England

[73] Assignee: Teleflex Morse Ltd., Basildon, England

[22] Filed: Jan. 20, 1975

[21] Appl. No.: 542,479

[30] Foreign Application Priority Data

Feb. 1, 1974 United Kingdom ..... 4858/74

[52] U.S. Cl. ..... 297/417

[51] Int. Cl.[2] ..... A47C 7/54

[58] Field of Search ..... 297/417, 411, 115, 116, 297/117, 375; 248/410, 118, 246; 403/119, 160; 16/48, 82

[56] References Cited

UNITED STATES PATENTS

| | | | |
|---|---|---|---|
| 2,661,227 | 12/1953 | Murphy | 297/417 X |
| 2,901,026 | 8/1959 | Thaden | 297/375 X |
| 3,310,008 | 3/1967 | Aleska et al. | 248/410 X |
| 3,467,352 | 9/1969 | Bohler | 248/246 X |
| 3,542,427 | 11/1970 | Herpel | 297/417 |
| 3,550,958 | 12/1970 | Krein | 297/417 |
| 3,612,606 | 10/1971 | Swenson | 297/417 |

FOREIGN PATENTS OR APPLICATIONS

| | | | |
|---|---|---|---|
| 1,230,843 | 5/1971 | United Kingdom | 248/410 |

*Primary Examiner*—James T. McCall
*Attorney, Agent, or Firm*—James C. Wray

[57] ABSTRACT

A seat arm adjustment mechanism has a stop block attached to the back of a seat, and a shaft slidably mounted in a housing on the arm bears against the stop block. A locking arm is slidably mounted on the shaft within a slot in the housing. A spring, disposed in the housing and positionally held by a screw, effects a biasing force against a face of the locking arm. A raised portion of the locking arm bears against a face of the housing. A second spring mounted on a screw between an end of the shaft and a bracket moves the shaft toward the stop block. An elongated rod is slidably mounted on the arm to bear against a face on the locking arm opposite the first spring. Pushing the rod against locking arm allows the locking arm to slide along the shaft, while the arm is being moved to a new selected position. The arm may be raised and lowered, whereupon it stops at the last selected position.

2 Claims, 2 Drawing Figures

SEAT ARM ADJUSTMENT MECHANISMS

This invention relates to seat arm adjustment mechanisms.

Figure 1:
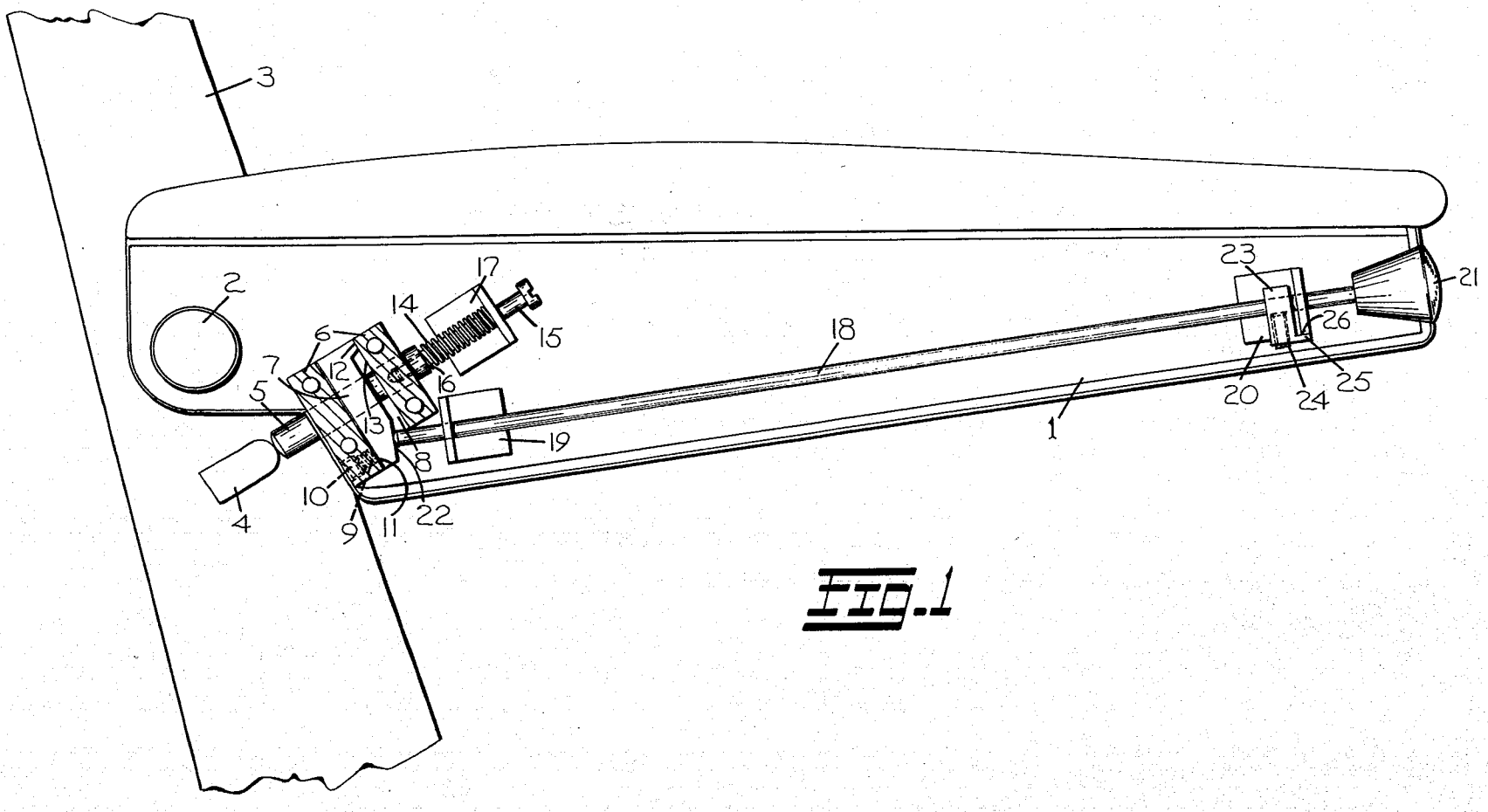
Figure 2:
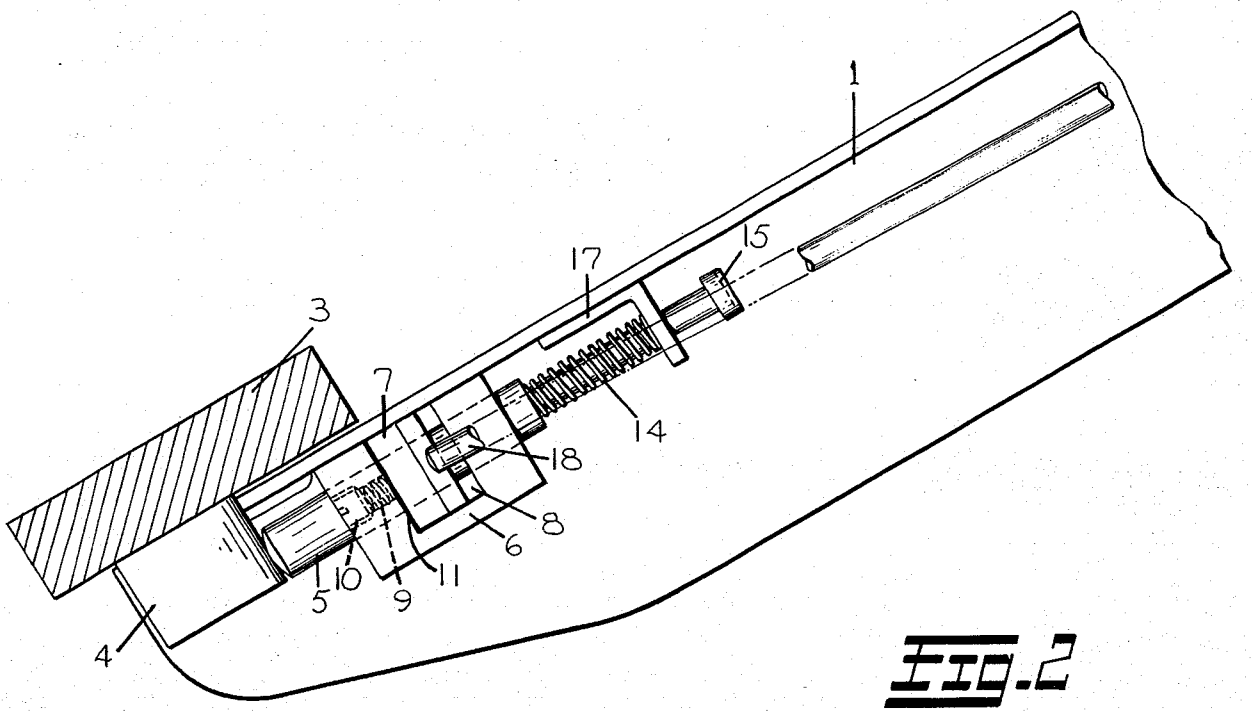

Features and advantages of the invention will appear from the following description of one embodiment thereof, given by way of example only, reference being had to the accompanying drawing in which:

FIG. 1 is a fragmentary side elevation, partly sectioned, of a seat arm adjustment mechanism incorporated in a seat arm pivotally attached to a seat back structure; and FIG. 2 is a fragmentary sectioned plan view of the assembly illustrated in FIG. 1.

It is generally a requirement on aircraft crew seats, that the height of the arms should be adjustable and that they should be capable of being easily raised to a stowing position. The present embodiment provides an adjustment mechanism achieving that requirement.

A seat arm 1 is pivotted at 2 on a seat back structure 3. The seat arm adjustment mechanism includes a stop block 4 attached to the seat back structure 3. A shaft 5 slidably mounted in a housing 6 mounted on the arm 1 bears against the block 4. A locking arm 7 is slidably mounted on the shaft 5 within a slot 8 in the housing 6. A spring 9 located in the housing 6 and held in position by a screw 10 bears against a face 11 of the locking arm 7. A raised portion 12 of the locking arm 7 bears against a face 13 of the housing 6. A light spring 14 mounted on a screw 15 between an end face 16 of the shaft 5 and a bracket 17 tends to move the shaft 5 towards the block 4. A rod 18 slidably mounted in two brackets 19 and 20, which are mounted on the arm 1, together with a knob 21 is arranged to bear against a face 22 on the locking arm 7 opposite the spring 9. An adjuster block 23 mounted on the rod 18 is held in position by a set-screw 24. The adjusting block 23 has a raised lip 25 which engages an edge 26 of the bracket 20 thus providing means to maintain the relative position of the adjusting block 23 to the arm 1.

In operation, the action of the spring 9 and the raised portion 12 bearing against the face 13 applies a moment to the locking arm 7 which, in turn, applies a frictional force to the shaft 5. Should a load be applied to the arm 1, the block 4 will transmit the load to the shaft 5 tending to move it. This will tend to move the locking army 7 due to the friction between the shaft 5 and the locking arm 7 and thus increase the load at the raised portion 12 which, in turn, increases the frictional force acting on the shaft 5 to prevent the shaft 5 moving and maintain the arm 1 in a stable position.

Should it be required to move the arm 1 to a different position, the knob 21 is depressed. This action will cause the rod 18 to move the locking arm 7 against the spring 9, thus reducing or eliminating the locking effect on the shaft 5 and permitting the shaft 5 to move. The arm 1 may now be moved to the new position required within the limits of the mechanism, the spring 14 maintaining the shaft 5 in contact with the block 4. On release of the knob 21, the shaft 5 will be relocked in the new position.

The adjusting block 23 is set such that should a load of a predetermined value be imposed on the arm 1, the resultant deflection of the locking arm 7 will move the rod 18 bringing the adjusting block 23 into contact with the bracket 20. If a load in excess of this predetermined value is imposed on the arm 1, since any further deflection of the locking arm 7 and hence greater locking force on the shaft 5 is prevented by the adjusting block 23 bearing against the bracket 20, the shaft 5 will slip in the locking arm 7 thus preventing damage due to excessive load.

The arm 1 can be raised to the vertical stowed position without operating the knob 21 and when re-lowered will return to the original position.

What is claimed is:

1. A seat arm adjustment mechanism comprising a stop block means attached to the back of a seat, a shaft slidably mounted in a housing mounted on the arm and bearing against said stop block means, a locking arm slidably mounted on said shaft within a slot in said housing, a biasing means disposed in said housing and positionally held by screw means, said spring effecting a biasing force against a face of said locking arm, a raised portion of said locking arm bearing against a face of said housing, spring biasing means mounted on a screw between an end portion of said shaft and a bracket means adapted to move said shaft toward said stop block means, an elongated rod slidably mounted on bracket means mounted on said arm, said rod having a knob attached thereto to bear against a face on said locking arm opposite said spring biasing member.

2. A seat arm adjustment mechanism in accordance with claim 1 wherein an adjustor block is mounted on said rod and is held in position by a set screw means, said adjustor block having a raised lip adapted to engaging edge of one of said brackets on said arm thereby providing a means to maintain the relative position of said adjusting block to said arm of said seat.

* * * * *